US006688879B2

(12) United States Patent
Tsai

(10) Patent No.: US 6,688,879 B2
(45) Date of Patent: Feb. 10, 2004

(54) SAFETY CATCH APPARATUS FOR A GAS BURNER

(76) Inventor: Chin-Lin Tsai, No. 94, Sec. 4, Chung Hsin Road, San Chung City, Taipei Hsien (TW)

( * ) Notice: Subject to any disclaimer, the term of this patent is extended or adjusted under 35 U.S.C. 154(b) by 106 days.

(21) Appl. No.: 10/097,734

(22) Filed: Mar. 15, 2002

(65) Prior Publication Data

US 2002/0115032 A1 Aug. 22, 2002

(30) Foreign Application Priority Data

Feb. 18, 2002 (TW) ..... 091201840

(51) Int. Cl.[7] ..... F23D 11/36; F23Q 7/12
(52) U.S. Cl. ..... 431/153; 431/255
(58) Field of Search ..... 431/153, 255, 431/344, 345

(56) References Cited

U.S. PATENT DOCUMENTS 5,505,614 A * 4/1996 Lin ..... 431/143
5,531,591 A * 7/1996 Yamazaki ..... 431/153
5,885,070 A * 3/1999 Lin ..... 431/255
5,975,888 A * 11/1999 Hsu ..... 431/255
6,065,959 A * 5/2000 Tsai ..... 431/255
6,093,017 A * 7/2000 Saito et al. ..... 431/153

* cited by examiner

*Primary Examiner*—Alfred Basichas

(74) *Attorney, Agent, or Firm*—Troxell Law Office PLLC

(57) ABSTRACT

A safety catch apparatus for a gas burner comprises a fixing part, a stir part and a catch part. The fixing part is two opposite sealing cover halves joining to each other. The fixing part has a circumferential edge with a central passage clearance at the periphery thereof and provides a projection post and at least a guide piece at the front and the rear surface thereof respectively. The stir part is held and located by way of the sealing cover halves and has a stir ring corresponding to the circumferential edge. An inner sector wing is perpendicular to the stir ring and is received in the passage clearance with an elastic expander disposed between the sector wing and an inner wall of the fixing part. The catch part has two opposite fitting holes at the middle portion thereof for fitting with the projection posts such that another elastic expander can be disposed between one of the fitting holes and an outer wall of the fixing part. A connecting rod at the top of the catch part to connect with and to move with an end of the stir ring, and two opposite support plates of the catch part extends downward. Once the stir ring is rotationally pushed to compress the elastic expanders, the connecting rod can rotate synchronously to separate the support plates from preset stop plates at an inner wall of an outer casing on the gas burner such that the entire safety catch apparatus can be pressed down and the guide piece can move downward along a rail groove preset on an inner wall of the outer casing to perform the gas supply the ignition procedure. Once the two elastic expanders are not pressed down, the two elastic expanders may stretch and the catch part and the catch part may restore to an original position thereof respectively to result in the support plates pressing against the stop plate in a state of locking.

12 Claims, 4 Drawing Sheets

SAFETY CATCH APPARATUS FOR A GAS BURNER

BACKGROUND OF THE INVENTION

1. Field of the Invention

The present invention relates to a safety catch apparatus for a gas burner and, particularly, to a safety catch apparatus, which is harder to be operated by children, to avoid being misused by the children and fulfill the safety regulations of all countries.

2. Description of Related Art

Due to the times having changed, a lighter or a burner have become a major fire taking device in our daily life instead of the match. A conventional burner such as the gas torch is loved by us very much and popularly used because it provides advantages of offering strong flames and being possible for the user to hold with one hand and to carry about him conveniently.

The burner is so popular that it is often placed around unintentionally in our daily lives and it is very easy for the children to reach such that the children may play with it due to the behavior of imitation and the curiosity thereof as soon as the burner is taken away by them. Accordingly, it is very possible to cause an accidental fire carelessly to endanger the safety of our lives and properties. Hence, it is too numerous to enumerate fire accidents caused by the children playing fires. It has been investigated that the safety switch of the conventional burner is designed to disarm easily based on the factor of being operated conveniently but it gives the children have chances to take fire with it jokingly to result in unexpected consequences.

According to the preceding safety consideration, governments of European countries and United States have made safety regulations concerning the burner and demand forcedly that the burner has to be provided with a safety catch apparatus. The U.S. Pat. Nos. 6,293,782 and 6,296,476, which are owned by the inventor, are typical examples obeying the safety regulations, that is, the burner is in a state of locking while not in use and it is necessary to disarm the safety catch apparatus before the fire being possible to be taken while in use. The operation of the preceding two U.S. patents are more difficult because of the step of disarming being added such that the children are unable to unlock the safety catch apparatus during playing the burner and the accidental disasters can be decreased substantially.

SUMMARY OF THE INVENTION

The crux of the present invention resides in that a safety catch apparatus is provided to comprise a fixing part, a stir part and a catch part. Wherein, the fixing part has two opposite sealing covers joining to each other and a circumferential edge with a central passage clearance at the periphery thereof and a projection post and at least a guide piece at the front and the rear surface thereof respectively. The stir part is held and located by way of the sealing covers and has a stir ring corresponding to the circumferential edge. An inner sector wing is perpendicular to the stir ring and is received in the passage clearance with an elastic expander disposed between the sector wing and the inner wall of the fixing part. The catch part has two opposite fitting holes at the middle portion thereof for engaging with the projection posts such that another elastic expander can be disposed between one of the fitting holes and the outer wall of the fixing part. A connecting rod at the top of the catch part to connect with and to move with an end of the stir ring, and two opposite support plates of the catch part extends downward. Once the stir ring is rotationally pushed to compress the elastic expanders, the connecting rod can rotate synchronously to separate the support plates from preset stop plates at the inner wall of an outer casing on the gas burner such that the entire safety catch apparatus can be pressed down and the guide piece can move downward along a rail groove preset on the inner wall of the outer casing to perform the gas ignition procedure. Once the two elastic expanders are not pressed down, the two elastic expanders may stretch and the catch part may restore to the original position thereof to result in the support plates pressing against the stop plate to form a state of locking.

BRIEF DESCRIPTION OF THE DRAWINGS

The present invention can be more fully understood by reference to the following description and accompanying drawings, in which.

DETAILED DESCRIPTION OF THE PREFERRED EMBODIMENTS

Figure 1:
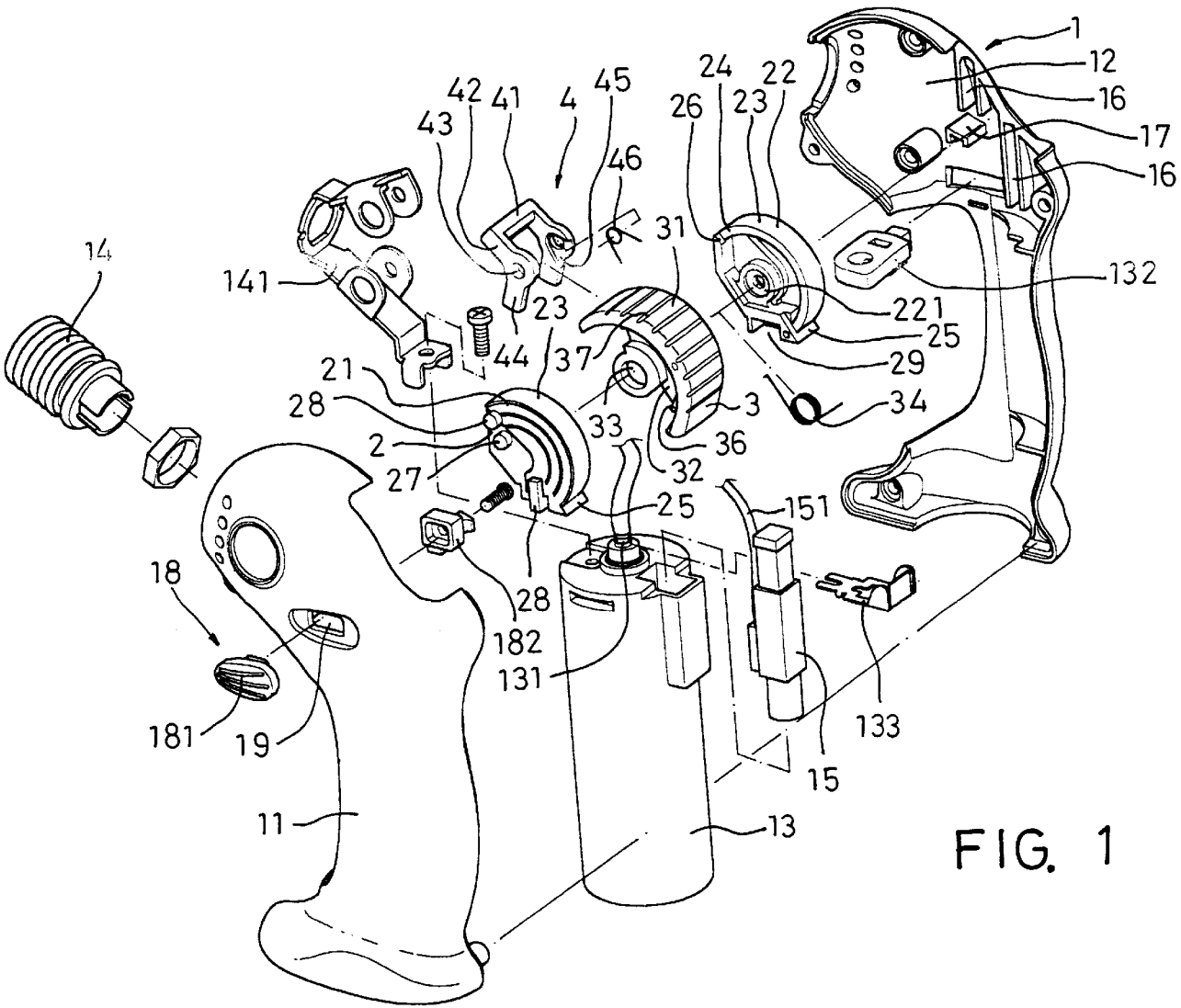
FIG. 1 is an exploded perspective view of a safety catch apparatus for a gas burner according to the present invention.
Figure 2:
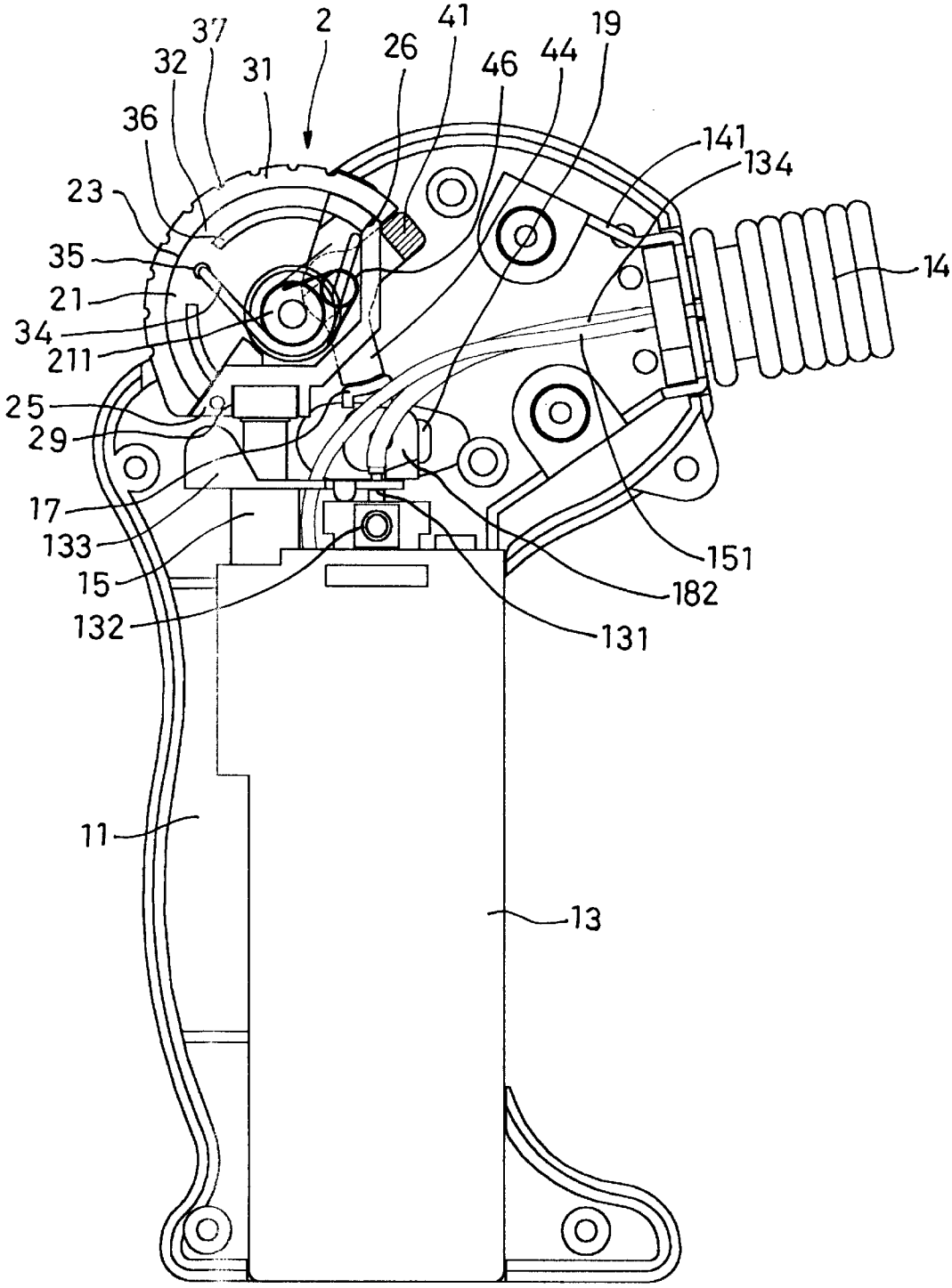
FIG. 2 is a sectional view of a safety catch apparatus for a burner shown in FIG. 1 after assembling.
Figure 3:
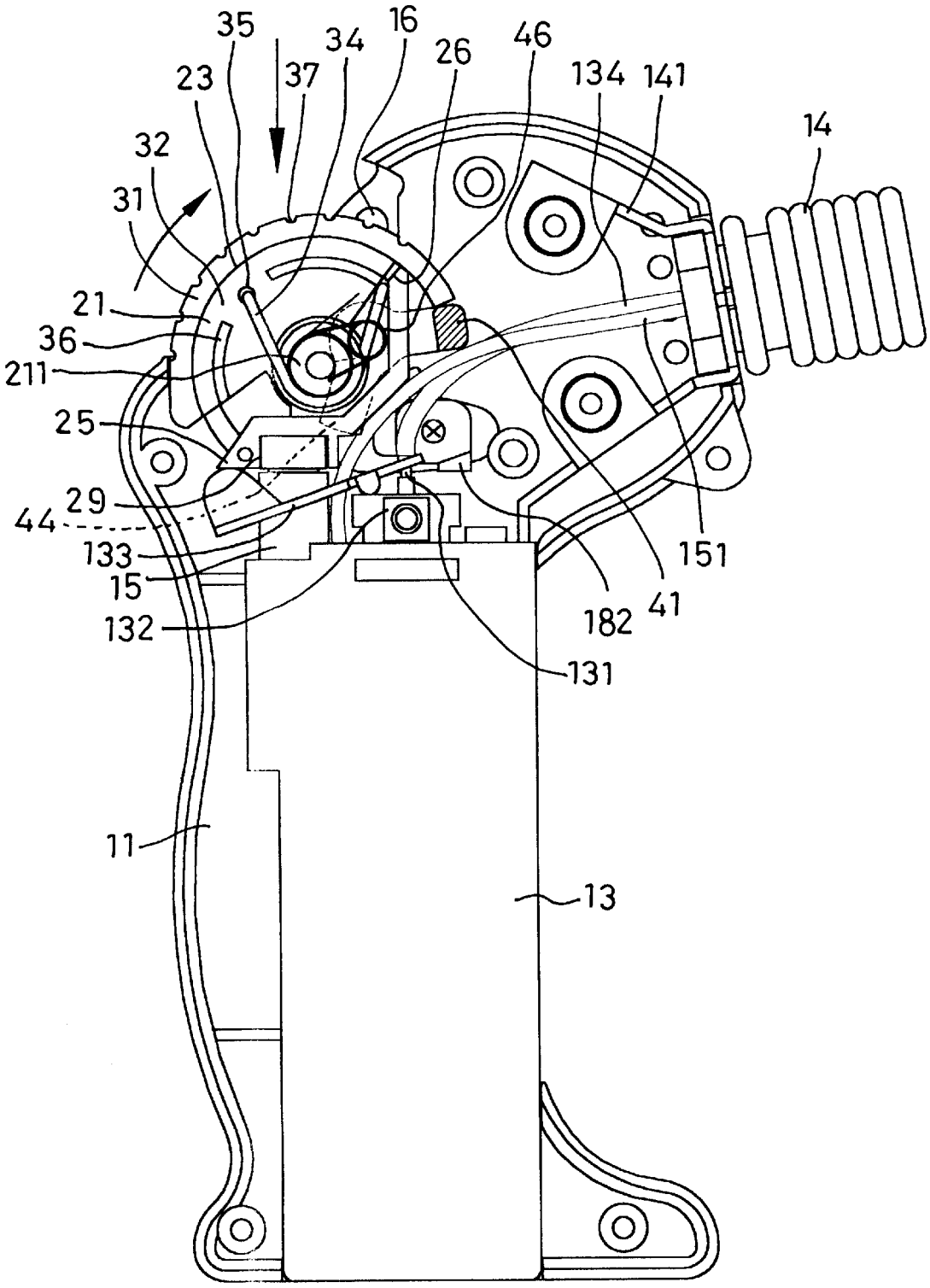
FIG. 3 is another sectional view similar to FIG. 2 illustrating the safety catch apparatus being in a state of disarmed.

Referring to FIGS. 1 to 3, basically, a safety catch apparatus for a gas burner according to the present invention, which is arranged at an opening on the periphery of a gas burner 1, comprises a fixing part 2, a stir part 3 and a catch part 4.

Wherein, the gas burner 1 is about the same as the conventional one, that is, the gas burner 1 has two opposite outer casinghalves 11, 12 joining to each other to form an enclosed space for receiving and locating a fuel cylinder 13, a flamethrower 14 and a piezo-electric device 15. Meanwhile, the fuel storage cylinder 13, the flamethrower 14 and the piezo-electric device 15 are connected to each other by way of a metal fixing arm 141, a lead wire 151 and a hose 134. The fuel cylinder 13 at the top thereof extends a gas mouth 131, which rotationally fits with an adjusting lever 132 for adjusting the amount of the gas supply. Besides, the gas mouth 131 is controlled with a press plate 133 so as to retreat inward or extend outward for the gas being cutout/admitted due to the moment of force of the press plate 133. The preceding description concerning the gas burner 1 is prior art and no detail will be described further. The present invention is different from the conventional gas burner in that the piezo-electric device 15 in the outer casing halves 11, 12 at least provides a recess rail 16 and a stop piece 17 and the outer casing 11 has a sustaining switch 18 being inset to the slide groove 19 along a slide key 181 and joined to a hook lever 182. When the gas mouth 131 is pulled up by the press plate 133, the slide key 181 moves backward and the hook lever 182 displaces under the press plate 133 such that the press plate 133 with the gas mouth 131 is unable to move downward and draw back downward so as to form a state of supplying the gas continuously.

The fixing part 2 is composed of two opposite sealing cover halves 21, 22 joining to each other and part of the sealing cover halves 21, 22 have a semicircular circumferential edge 23 with a central passage clearance 24 for sector wings 32 of the stir part 3 being disposed therein and extending outward. Both ends of the semicircular circumferential edge 23 have an outer stop 25 and an inner stop rim 26 as a limit of standstill and a limit of forward push for the stir part 3. In order to axially connect the stir part 3 to the fixing part 2, the sealing cover half 21 has an inner projection 211 to fit with a corresponding engaging projection 221 in the other sealing cover half 22 and the inner projection 211 and the engaging projection 221 are fastened together by way of a screw. Besides, the fixing part 2 at both outer lateral sides thereof provides an engaging post 27 and at least a guide part 28, such as a projection piece or a rib, to join with the catch part 4. Further, the fixing part 2 at bottom thereof has a connect groove 29 for being attached to the top of the piezoelectric device 15.

The stir part 3 is disposed between sealing cover halves 21, 22 of the fixing part 2 and provides a stir ring 31 corresponding to the circumferential edge 23 and the sector wing 32 respectively, wherein, the sector wing 32 vertically extends from the inner central position of the stir ring 31 with an axial hole 33 at the free end thereof. The axial hole 33 fits with the inner projection 211 and an elastic expander such as a torsion spring 34 is arranged to fit with the inner projection 211 in a way of an end of the torsion spring 34 engaging with a wing hole 35 on the sector wing 32 and the other end of the torsion spring 34 pressing against the inner wall of the inner projection 21 such that an end of the stir part 3 can press against the outer stop 25 constantly prior to the stir part 3 is operated. Besides, in order to rotationally move along the circumferential edge 23, the stir part 3 at two opposite lateral sides of the sector wing 32 thereof provides an arched part 36 respectively corresponding to the wall thickness and the curvature of the circumferential edge 32 such that the arched parts 36 can hold the circumferential edge 32 with the stir ring 31 to facilitate the angular movement of the circumferential edge 32. Further, the stir ring 31 at the outer surface thereof may provides a plurality of embossed lines 37 to increase the friction force and facilitate the operation while the stir part 3 is pushed forward with a thumb.

The catch part 4 is a frame and provides an upper connecting rod 41 with both ends thereof extending downward a perpendicular stretch plate 42 respectively. Further, An end of each stretch plate 42 extends downward a support plate 44 and a fitting hole 43 is provided between the stretch plate 42 and the support plate 44 for fitting with the engaging post 27. The support plates 44 contact with the guide plates 28 to perform the function of catching. Wherein, in order to offer a function of moving back to the original position, one of the fitting holes 43 provides a sector recess 45 at the inner wall thereof and the corresponding engaging post 27 is enclosed with an elastic expander such as a torsion spring 46 such that both ends of the torsion spring rest at the sector recess 45 and the outer wall of the fixing plate 2. Thus, the connecting rod 41 can press the stir ring 31 constantly and moves along with the stir ring 31 due to the stretching force of the torsion spring 46.

Figure 4:
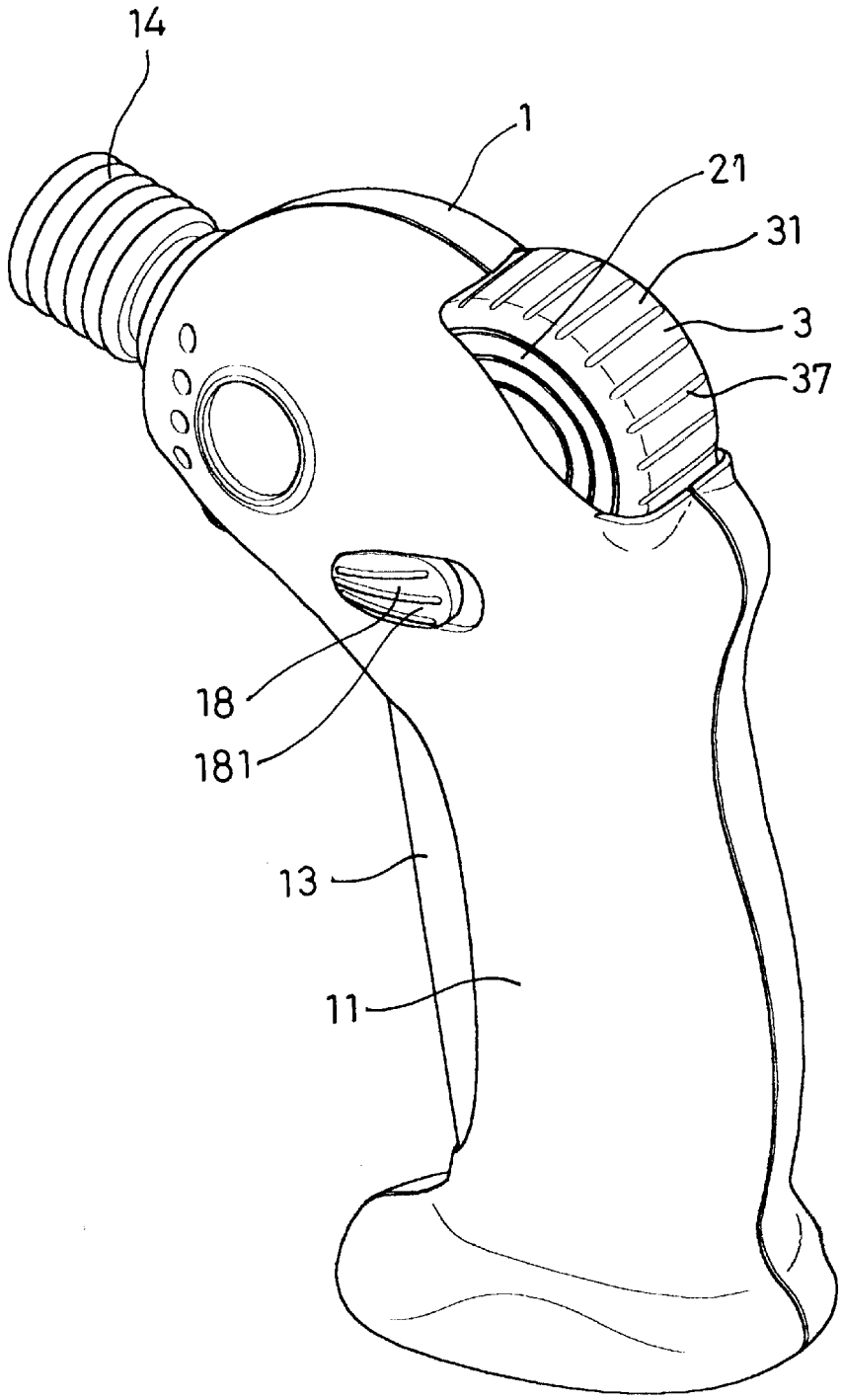
FIG. 4 is an assembled perspective view of the burner with the safety catch apparatus shown in FIG. 1.

As soon as the parts of the gas burner 1 according to the present invention are assembled as the preceding instruction, the gas burner 1 can be formed as the appearance shown in FIG. 4. Referring to FIGS. 2 and 3 again, the operation of the gas burner 1 will be described hereinafter. The user can turn the stir ring 31 forward by way of a thumb with a exerting force greater than the stretching force of the torsion spring 34 such that the stir ring 31 can perform an angular displacement along the circumferential edge 23 and the connecting rod 41 of the catch part 4 can move along with the stir ring 41 and rotate with respect to the projection post 27. Hence, the support plates 44 becomes apart from the stop plate 17 and compress the torsion spring 46 so that it causes a function of loosening the catch. Besides, the entire safety catch apparatus can be pressed down to move the guide piece 28 downward along the rail groove 16 and the piezoelectric device 15 and the press plate 133 can be squeezed synchronously such that the gas mouth 131 can be pulled up to transmit the gas to the flamethrower 14 via the hose 134. The gas at the flamethrower 14 can be ignited with the spark introduced at the end of the lead wire 151 connected to the piezo-electric device 15 such that an operation of combustion can be performed. In case of the gas burner of the present invention being not in use, the user can detach the thumb from the stir ring 31 and the safety catch apparatus will move upward due to both the piezo-electric device 15 and the torsion springs 34, 46 bouncing back such that the stir ring 31 and the support plates 44 can move back to the original positions thereof to perform a function of catching with the stop plate 17. That is, the entire safety catch apparatus is not possible to be press downward as shown in FIG. 2.

If the user is unwilling to keep pressing the safety catch device, the sustaining switch 18 at the hook lever 18 thereof can be stirred to catch the lower part of the press plate 133 such that a state of continuous gas supply can be maintained constantly.

As the foregoing, it is appreciated that the operation of the safety catch apparatus in the gas burner of the present invention is performed by way of rotational mode instead of the horizontal or vertical mode usually done by the conventional gas burner. That is, the user has to exert a force greater than the stretching force of an elastic expander before the stir piece can rotate along the surface of the fixing part while the safety catch device of the present invention is in operation so that the support plates of the catch part can rotate with respect to the projection posts to be apart from the stop plates on the outer casings for the state of catching being able to be disarmed. The arrangement of the present invention can prevent from any possible disaster due to being played by the child because it is hard for a child to exert a thumb force during operating the safety catch apparatus of the present invention and it is too sophisticate and complicate for a child to operate the safety catch apparatus of the present invention well. Besides, each part of the present invention is in a state of locking automatically with a dynamic catch before the operation being performed by way of two elastic expanders so that the present invention is very personalized from the standpoint of design. Furthermore, each part of the present invention is designed by way of modularization and the assembling job can be carried out with facility, which is not possible for the conventional burner to reach effectively.

While the invention has been described with reference to the preferred embodiment thereof, it is to be understood that modifications or variations may be easily made without departing from the spirit of this invention, which is defined by the appended claims.

What is claimed is:

1. A safety catch apparatus for a gas burner, comprising:

a fixing part, being two opposite sealing covers joining to each other, having a circular edge with a central passage clearance at a periphery thereof, and providing a projection post and at least a guide piece at a front and a rear surface thereof respectively;

a stir part, being held and located with the sealing covers, having a stir ring corresponding to the circumferential edge, extending an inner sector wing perpendicular to the stir ring and being received in the passage clearance, and having a first elastic expander disposed between the sector wing and an inner wall of the fixing part;

a catch part, having two opposite fitting holes at a middle portion thereof for fitting with the projection posts such that a second elastic expander can be disposed between one of the fitting holes and an outer wall of the fixing part, providing a connecting rod at an top thereof to connect with and to move with an end of the stir ring, and extending downward two opposite support plates;

whereby, once the stir ring is rotationally pushed to compress the first and the second elastic expander, the connecting rod can rotate synchronously to separate the support plates from preset stop plates at an inner wall of an outer casing on the gas burner such that the entire safety catch apparatus can be pressed down and the guide piece can move downward along a rail groove preset on an inner wall of the outer casing to perform the gas supply the ignition procedure; and once the two elastic expanders are not pressed down, the two elastic expanders may stretch and the catch part and the catch part may restore to an original position thereof respectively to result in the support plates pressing against the stop plate in a state of locking.

2. The safety catch apparatus for a gas burner according to claim 1, wherein one of the sealing covers provides an inner projection for fitting with an axial hole at a free end of the sector wing with being enclosed with the first elastic expander; and then an engaging projection of the other one of the sealing covers engaging with the inner projection.

3. The safety catch apparatus for a gas burner according to claim 2, wherein the first elastic expander at an end thereof is attached to at least a wing hole of the sector wing and at another end thereof presses against an inner wall of the fixing plate.

4. The safety catch apparatus for a gas burner according to claim 2, wherein the two sealing covers are associated with the stir part as one piece by way of the inner projection and the engaging projection being joined to each other with a screw.

5. The safety catch apparatus for a gas burner according to claim 1, wherein the circular edge at two ends thereof has an outer stop and an inner stop as an standstill limit and a moving forward limit for the stir ring and the sector wing.

6. The safety catch apparatus for a gas burner according to claim 1, wherein the fixing part at a bottom thereof is formed with a connecting groove for connecting with a top of a piezo-electric device.

7. The safety catch apparatus for a gas burner according to claim 1, wherein the guide piece is a projection or a rib.

8. The safety catch apparatus for a gas burner according to claim 1, wherein the stir ring at an surface thereof is provided with embossed lines.

9. The safety catch apparatus for a gas burner according to claim 1, wherein the sector wing at both lateral sides thereof provides an arched projection respectively corresponding to a wall thickness of the circumferential edge so as to hold the circumferential edge with the stir ring.

10. The safety catch apparatus for a gas burner according to claim 1, wherein the catch part at one of the fitting holes provides an inner sector recess for connecting with an end of the second elastic expander and the another end of the second elastic expander presses against an outer wall of the fixing part.

11. The safety catch apparatus for a gas burner according to claim 1, wherein the first and the second elastic expander are torsion springs.

12. The safety catch apparatus for a gas burner according to claim 1, wherein the gas burner at the outer casing part thereof provides a sustaining switch, which has a slide key to be inset to a slide groove of the outer casing part; and after a press plate pulls up a gas mouth, the hook lever can be moved under the press plate by way of stirring the slide key to keep the gas mouth in a state of supplying the gas.

* * * * *